US006577279B1

(12) United States Patent
Shoji et al.

(10) Patent No.: US 6,577,279 B1
(45) Date of Patent: Jun. 10, 2003

(54) ANTENNA STRUCTURE OF PORTABLE RADIO

(75) Inventors: Hideaki Shoji, Hyogo (JP); Yasuhito Imanishi, Hyogo (JP); Toru Fukasawa, Hyogo (JP); Hiroyuki Ohmine, Hyogo (JP)

(73) Assignee: Mitsubishi Denki Kabushiki Kaisha (JP)

( * ) Notice: Subject to any disclaimer, the term of this patent is extended or adjusted under 35 U.S.C. 154(b) by 0 days.

(21) Appl. No.: 09/936,441

(22) PCT Filed: Jan. 14, 2000

(86) PCT No.: PCT/JP00/00157

§ 371 (c)(1),
(2), (4) Date: Sep. 13, 2001

(87) PCT Pub. No.: WO01/52349

PCT Pub. Date: Jul. 19, 2001

(51) Int. Cl.[7] ..... H01Q 1/24
(52) U.S. Cl. ..... 343/702; 343/900
(58) Field of Search ..... 343/702, 900, 343/901, 906; H01Q 1/24

(56) References Cited

U.S. PATENT DOCUMENTS

| | | | | |
|---|---|---|---|---|
| 5,559,522 A | | 9/1996 | Seitz | |
| 5,590,416 A | | 12/1996 | Rydbeck | |
| 5,613,224 A | | 3/1997 | Auvray | |
| 6,104,350 A | * | 8/2000 | Ng et al. | 343/702 |
| 6,225,953 B1 | * | 5/2001 | Kamei et al. | 343/702 |
| 6,300,910 B1 | * | 10/2001 | Kim | 343/702 |
| 6,360,082 B1 | * | 3/2002 | Pitz et al. | 343/702 |

FOREIGN PATENT DOCUMENTS

| | | |
|---|---|---|
| EP | 0 611 199 A | 8/1994 |
| EP | 0 652 646 A | 5/1995 |
| EP | 0 764 998 A | 3/1997 |
| JP | 01 120108 A | 5/1989 |
| JP | 2-47814 U | 4/1990 |
| JP | 05014027 A | 1/1993 |
| JP | 05055817 A | 3/1993 |
| JP | 06260959 A | 9/1994 |
| JP | 06268547 A | 9/1994 |
| JP | 07307607 A | 11/1995 |
| JP | 08 125418 A | 5/1996 |
| JP | 08 274525 A | 10/1996 |
| JP | 08274525 A | 10/1996 |
| JP | 10 013123 A | 1/1998 |

* cited by examiner

*Primary Examiner*—Hoanganh Le
(74) *Attorney, Agent, or Firm*—Rothwell, Figg, Ernst & Manbeck, p.c.

(57) ABSTRACT

A slide lever (6) is provided to a cabinet (2) of portable radio equipment, and an antenna (3) formed by nickel elastic alloy is held by a holding member (5). A lower portion of the antenna engages with an engaging portion (61) of slide lever (6), and by sliding slide lever (6), the lower portion of antenna (3) is bent at engaging portion (61) such that the entire antenna is inclined in a vertical direction by a desired angle, thereby reducing loss due to nonconformity of polarization with respect to an antenna of a base station.

9 Claims, 5 Drawing Sheets

ANTENNA STRUCTURE OF PORTABLE RADIO

BACKGROUND OF THE INVENTION

1. Field of the Invention

The present invention relates to an antenna structure for portable radio equipment, and more specifically, to an antenna structure for portable radio equipment that allows inclining an antenna to a desired angle in order to improve sensitivity of the portable radio equipment.

2. Description of the Related Art

Existing types of transmitting/receiving antennas of portable radio equipment include a whip antenna mounted in a longitudinal direction of a cabinet and a helical antenna. The most often adopted antenna for portable radio equipment currently commercially available in Japan is a whip and helical antenna having a structure that operates as a whip antenna when pulled out and in that, when retracted, a helical antenna operates that is provided on a tip of the whip antenna with an insulating material intervening therebetween. In addition, an inverted F antenna or the like is built into the cabinet as an antenna for reception diversity.

In general, one factor that degrades antenna characteristic is antenna efficiency determined by an effective radiation area owing to the physical size and the structure of the antenna. Moreover, there is loss due to impedance mismatch with a radio unit and loss due to nonconformity of polarization plane and directivity in relation to an antenna that is a target of communication. Since the environment in which an antenna on mobile equipment of mobile communications such as portable radio equipment is installed or held constantly changes, directivity and plane of polarization vary constantly.

An antenna of a base station that communicates with portable radio equipment through transmission and reception is configured with vertical polarization as the main polarization. Transmission waves from a transmitting/receiving antenna of the base station are repeatedly reflected and diffracted by various structures such as buildings before they arrive at a receiving antenna of portable radio equipment. Vertical polarization, however, is generally known to be dominant as the main polarization of the waves arriving at portable radio equipment from the base station. In the reception characteristic of the transmitting/receiving antenna of the base station, it is obvious from the reversibility of the transmission/reception characteristic of the antenna that the greater the vertical polarization component in the waves arriving from portable radio equipment, the higher the gain of the antenna becomes.

Whip antennas and the like formed on portable radio equipment have radiation patterns of various forms depending on an electrical length of an antenna element and a dimension of the cabinet. When the portable radio equipment is provided such that it stands upright, the main polarization is known to become vertical polarization in relation to the ground.

Thus, during a call on portable radio equipment (often used with an inclination of about 60° from the direction of the zenith) or when the portable radio equipment is placed horizontally on a desk and the like, nonconformity in the direction of main polarization becomes significant between the antenna formed on the portable radio equipment and the antenna of the base station that has vertical polarization in relation to the ground, and the gain of the antenna is disadvantageously degraded.

FIGS. 6A and 6B are diagrams related to the description of polarization loss when portable radio equipment is inclined. As shown in FIG. 6A, Eθ indicates an electric field level of vertical polarization and Eϕ indicates an electric field level of horizontal polarization when portable radio equipment 1 is erected vertically. As shown in FIG. 6B, when portable radio equipment 1 is inclined by 60°, the electric field level of vertical polarization becomes Eθ' and the electric field level of horizontal polarization becomes Eϕ', producing a polarization loss as indicated by the following expression:

$$\text{Polarization loss}=20\log_{10}(E\theta/E\theta')\text{dB}.$$

In order to reduce such polarization loss, conventionally, techniques are proposed of providing a metal joint portion, for example, in order mechanically to incline the antenna alone, for instance, in Japanese Patent Laying-Open No. 8-274525, Japanese Patent Laying-Open No. 6-260959, and Japanese Patent Laying-Open No. 5-55817.

These mechanisms, however, may disadvantageously involve an increase in the number of parts and may easily break when portable radio equipment 1 is dropped.

SUMMARY OF THE INVENTION

Thus, the principal object of the present invention is to provide an antenna structure for portable radio equipment that can be formed with a small number of parts, that allows inclining of the antenna to a desired angle, and that can reduce loss due to nonconformity of polarization.

The present invention is an antenna structure mounted on a cabinet 15 of portable radio equipment including an antenna made of a conductor of elastic alloy and an inclining portion provided on a cabinet for inclining the antenna.

Preferably, the antenna has vertical polarization and the inclining portion inclines a polarization plane of the antenna to a direction vertical to the ground.

Preferably, the inclining portion includes a sliding member whose tip engages a lower portion of the antenna within the cabinet and which slides to incline the antenna.

Preferably, the inclining portion includes a stopping member whose upper end engagingly stops against the antenna outside the cabinet and which inclines the antenna.

Preferably, the inclining portion includes a disk member having a groove that is cut away departing from a center, and a lower portion of the antenna is inserted in the groove of the disk member and the disk member is rotated to incline the antenna.

Another aspect of the present invention is an antenna structure mounted on a cabinet of portable radio equipment, characterized in that a polarization plane of an antenna having vertical polarization during a call and having a length of $\lambda/2$ is inclined to a direction vertical to the ground.

BEST MODES FOR CARRYING OUT THE INVENTION

Figure 1:
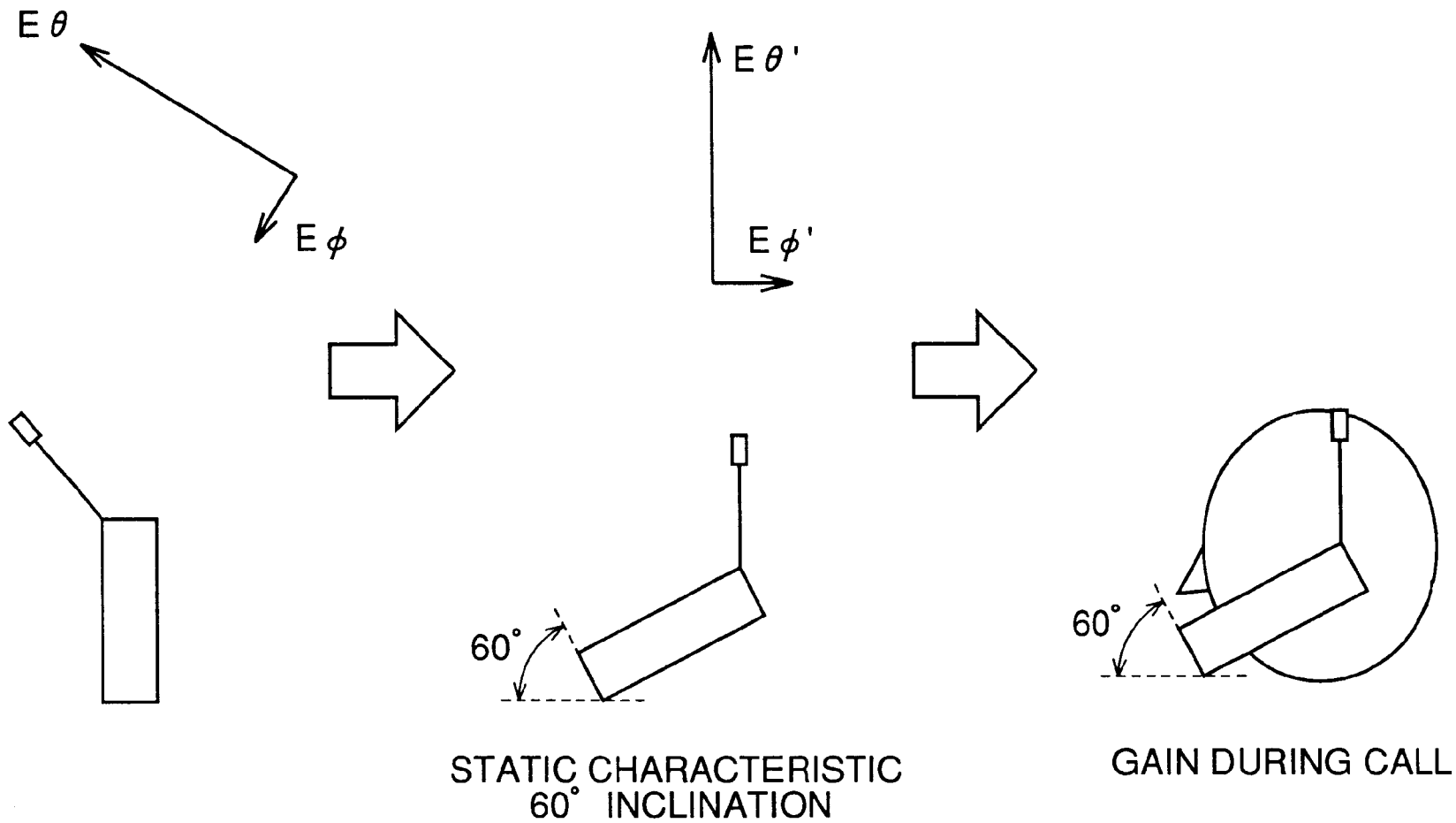
FIG. 1 is a conceptual diagram of the present invention.

FIG. 1 is a conceptual diagram of the present invention. In the present invention, an antenna that can be flexibly bent is provided to a cabinet of portable radio equipment 1 such that an electric field level Eθ of vertical polarization and an electric field level Eϕ of horizontal polarization when portable radio equipment 1 is erected are made substantially equal to an electric field level Eθ' of vertical polarization and an electric field level Eϕ' of horizontal polarization when portable radio equipment 1 is inclined, for instance, by 60° in use during a call, thereby reducing polarization loss.

Figure 2A:
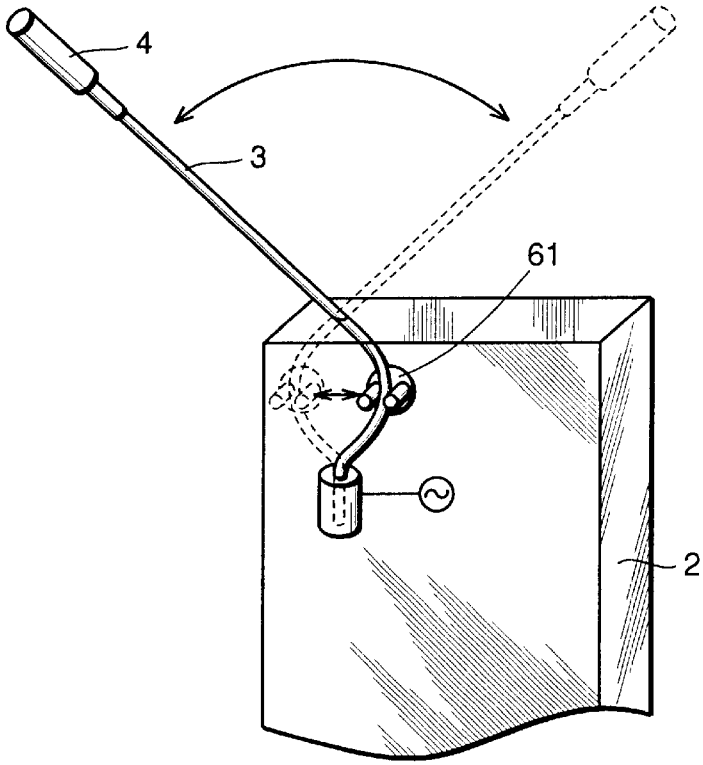
FIGS. 2A and 2B are diagrams showing an antenna structure of portable radio equipment according to one embodiment of the present invention.
Figure 2B:
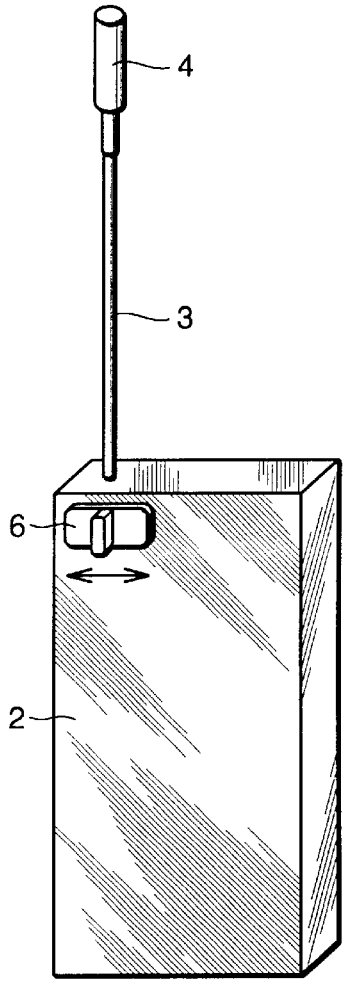

FIG. 2A is a diagram of an antenna structure of portable radio equipment according to one embodiment of the present invention viewed from the rear side, and FIG. 2B is a diagram of the portable radio equipment provided with a slide lever for inclining the antenna, viewed from the front. An antenna 3 shown in FIGS. 2A and 2B utilizes nickel elastic alloy, for instance, and is flexible to any desired angle. A helical antenna 4 is provided in an upper portion of antenna 3, a lower portion of antenna 3 is held by a holding portion 5 as shown in FIG. 2A, and a slide lever 6 is provided above holding portion 5. An engaging portion 61 for engaging with antenna 3 is formed in a backside of slide lever 6. Slide lever 6 is configured such that it is slidable in a horizontal direction along a groove not shown. When slide lever 6 slides to a central position, antenna 3 stands upright in relation to cabinet 2, and antenna 3 can be inclined to any desired angle by sliding slide lever 6 to the right or to the left.

As described above, according to this embodiment, an elastic antenna 3 can be inclined by a desired angle by merely sliding slide lever 6. Thus, if a caller notices the poor sensitivity during a call, the caller may manipulate slide lever 6 to determine an angle of inclination of antenna 3 such that an angle with highest sensitivity can be obtained.

Moreover, since it is only required that antenna 3 be formed with elastic alloy and that slide lever 6 be provided, the number of parts can be reduced, and because of a complex mechanical structure, there is little risk of antenna 1 being broken even when dropped by mistake.

Figure 3A:
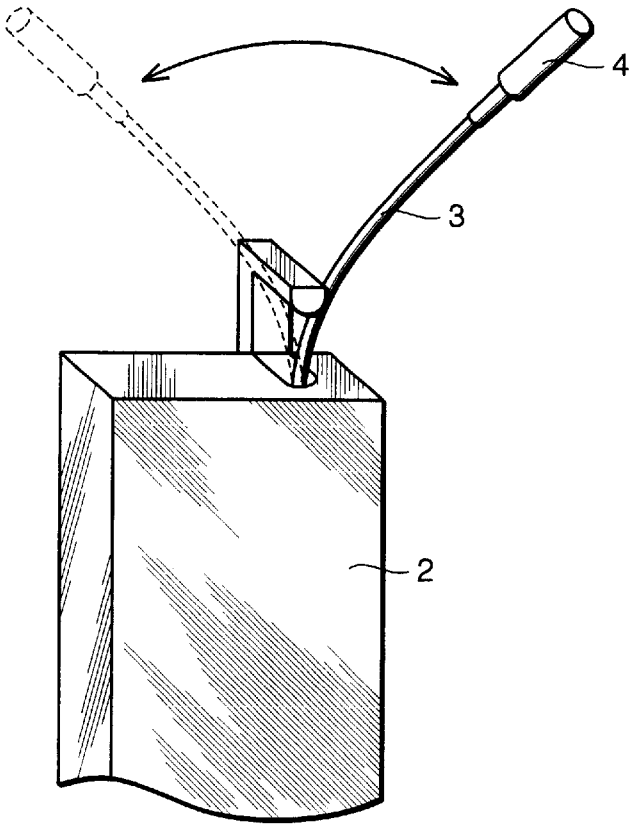
FIGS. 3A to 3C are diagrams showing an antenna structure according to a second embodiment of the present invention.
Figure 3B:
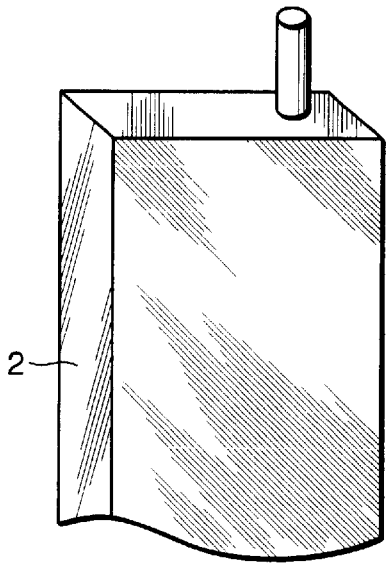
Figure 3C:
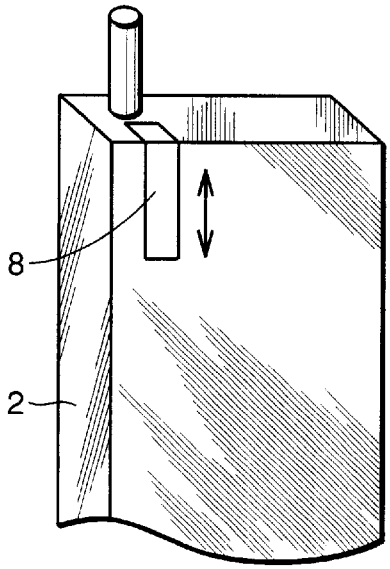

FIGS. 3A to 3C are diagrams showing an antenna structure according to the second embodiment of the present invention.

In the embodiment shown in FIGS. 3A to 3C, a stopping member 8 that is slidable up and down is provided on an upper portion of a cabinet 2. Here, an antenna 3 is formed by nickel elastic alloy as in the embodiment of FIGS. 2A and 2B. Thus, antenna 3 is flexible to any given angle, and a tip of stopping member 8 engagingly stops against antenna 3 such that stopping member 8 may be moved up and down to incline antenna 3 to any desired angle.

Therefore, this embodiment also allows adjustment of the angle of inclination of antenna 3 such that sensitivity is maximized while a caller has portable radio equipment tilted in use during a call.

Figure 4A:
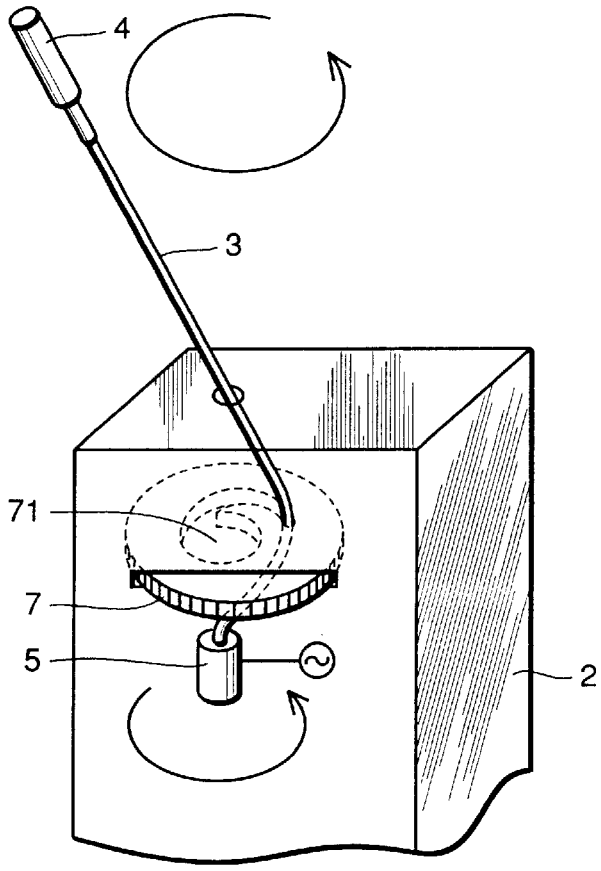
FIGS. 4A and 4B are diagrams showing an antenna structure according to a third embodiment of the present invention.
Figure 4B:
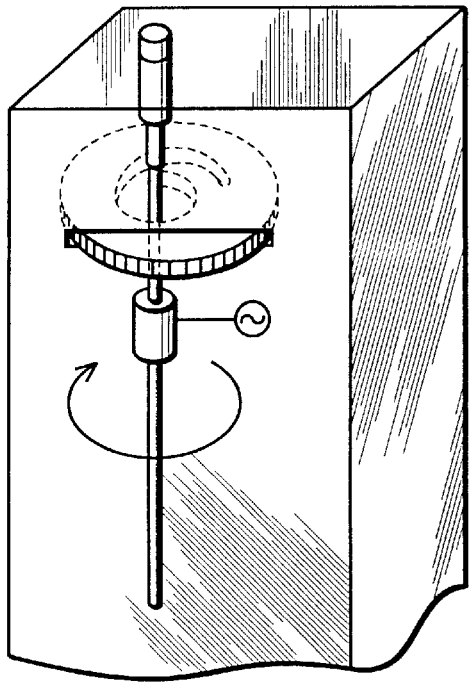

FIGS. 4A and 4B are diagrams showing an antenna structure according to the third embodiment of the present invention. An antenna 3 is made of nickel elastic alloy, and has its lower portion held by a holding portion 5, and has a disk member 7 provided on its upper portion. A groove 71 that is cut away and departing from a center is formed in disk member 7, and antenna 3 is inserted in groove 71. A portion of a peripheral surface of disk member 7 protrudes from a cabinet 2, and when a caller touches that portion with a finger to rotate disk member 7, antenna 3 slidably moves along groove 71 since groove 71 departs from a center, and the angle of inclination of antennas changes.

When storing antenna 3 within cabinet 2, disk member 7 is rotated so as to locate antenna 3 in the center of groove 71, and thus, antenna 3 is received in the cabinet.

Figure 5A:
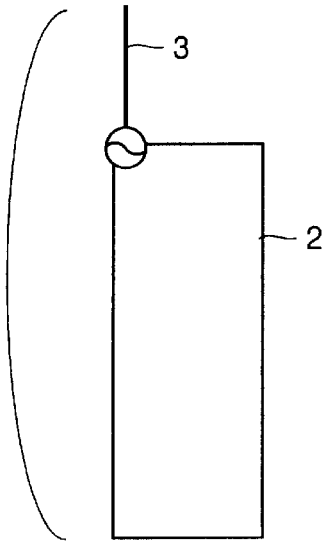
FIGS. 5A and 5B are diagrams showing a further embodiment of the present invention.
Figure 5B:
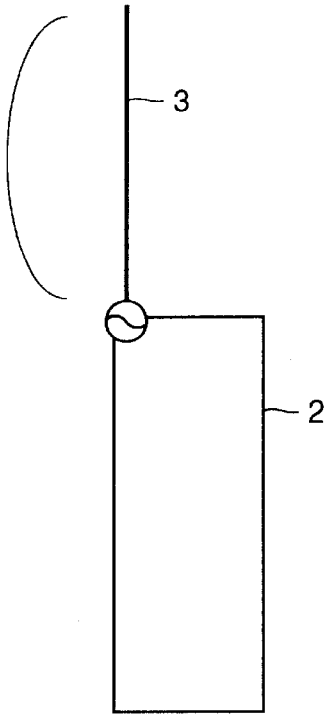
Figure 6A:
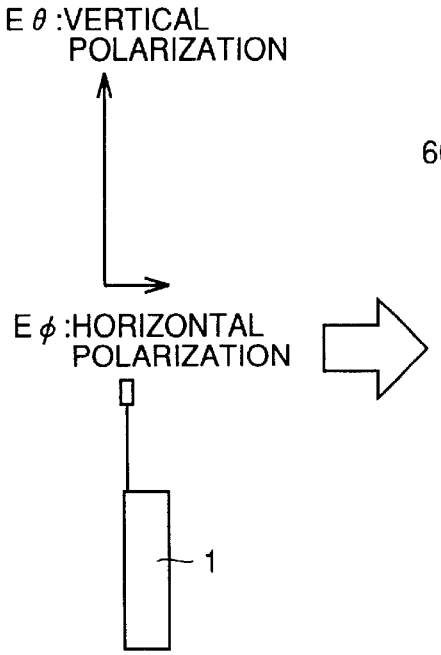
FIG.6A PRIOR ART
FIGS. 6A and 6B are diagrams related to the description of polarization loss when portable radio equipment is inclined.
Figure 6B:
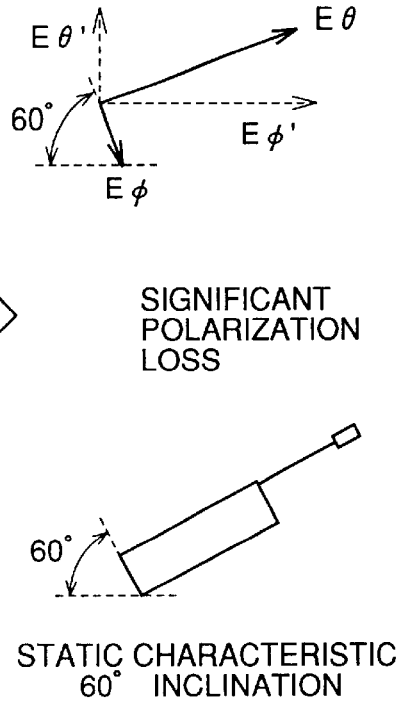
FIG.6B PRIOR ART

FIGS. 5A and 5B are diagrams showing a further embodiment of the present invention. Specifically, FIG. 5A shows a λ/4 type antenna, while FIG. 5B shows a λ/2 type antenna.

While the added length of a length of an antenna 3 and a length in a longitudinal direction of a cabinet 2 is selected to be λ/4 in the λ/4 type antenna shown in FIG. 5A, the length of antenna 3 alone is selected to be λ/2 for the λ/2 type antenna shown in FIG. 5B. Thus, in the λ/2 type antenna, a current closes in the vicinity of a portion where antenna 3 and cabinet 2 are joined so that a current hardly flows through cabinet 2 and the current flows through antenna 3 alone. Consequently, a greater reduction effect of polarization loss upon inclining of antenna 3 can be achieved.

Therefore, in each of the above-described embodiments, it is desirable to select N times λ/2 (N is an integer) such as λ2, λ, 3/2·λ for antenna 3. This is based on the fact that a frequency band used for a portable telephone in recent years is as high as 2 GHz and one wavelength is 15 cm, and that, at λ/2, an antenna at 7.5 cm can be resonated.

As described above, according to the present invention, an antenna can be provided with flexibility by using elastic alloy as a conductor for the antenna, for instance, and the antenna can be bent during a call such that it is inclined in a direction vertical to the ground, thereby reducing loss due to nonconformity of polarization with respect to an antenna of a base station. In addition, according to the present invention, no mechanism for inclining the antenna provided to the antenna it self is required so that the antenna should not be broken when dropped, and lighter weight can be achieved since the number of parts is small. In particular, the present invention can be applied effectively to an antenna that resonates at N times λ/2.

The embodiments of the present invention were described above in detail with reference to the drawings. The present invention, however, is not limited to the embodiments, and is subject to various modifications and alterations within the scope of the concept of the present invention. The scope of the present invention is defined by the description given in the appended claims.

What is claimed is:

1. An antenna structure mounted on a cabinet of portable radio equipment for inclining the antenna to reduce polarization loss, comprising:

a rod shaped antenna mounted to the cabinet and a bending portion provided on said cabinet for bending and inclining the rod shaped antenna, wherein the rod shaped antenna is made of a conductor of an elastic alloy and flexibly bendable; and the bending portion is movably adapted to act on the rod shaped antenna so as to flexibly bend the antenna into a desired inclination.

2. The antenna structure of portable radio equipment according to claim 1, characterized in that said antenna has vertical polarization, and said bending portion inclines a polarization plane of said antenna to a direction vertical to a ground.

3. The antenna structure of portable radio equipment according to claim 2, wherein said bending portion includes a sliding member whose tip engages a lower portion of said antenna within said cabinet and which slides to incline the antenna.

4. The antenna structure of portable radio equipment according to claim 2, wherein said bending portion includes a stopping member whose upper end engagingly stops against the antenna outside the cabinet and which inclines the antenna.

5. The antenna structure of portable radio equipment according to claim 2, characterized in that said bending portion includes a disk member having a groove that is cut away departing from a center, and a lower portion of said antenna is inserted in the groove of said disk member and the disk member is rotated to incline said antenna.

6. The antenna structure of portable radio equipment according to claim 1, characterized in that a polarization plane of said antenna having vertical polarization during a call and having a length of N times $\lambda/2$ (N is an integer) is inclined to a direction vertical to the ground.

7. The antenna structure of portable radio equipment according to claim 1, wherein said alloy is a nickel elastic alloy.

8. An antenna structure, mounted on a cabinet of portable radio equipment, comprising:

an antenna made of a conductor of elastic alloy; and a bending portion provided on said cabinet for bending and inclining said antenna; wherein said bending portion includes a sliding member whose tip engages a lower portion of said antenna within said cabinet and which slides to incline the antenna.

9. An antenna structure mounted on a cabinet of portable radio equipment, comprising:

an antenna made of a conductor of elastic alloy; and a bending portion provided on said cabinet for bending and inclining said antenna; wherein said bending portion includes a disk member having a groove that is cut away departing from a center, and a lower portion of said antenna is inserted in the groove of said disk member and the disk member is rotated to incline said antenna.

* * * * *